US011071667B2

(12) United States Patent
Wurdeman

(10) Patent No.: US 11,071,667 B2
(45) **Date of Patent: *Jul. 27, 2021**

(54) HOSPITAL CHAIR BEDS WITH EXTENDABLE/RETRACTABLE FOOT SECTIONS

(71) Applicant: RESOLUTION BED, INC., Dobson, NC (US)

(72) Inventor: Byron Wade Wurdeman, Dobson, NC (US)

(73) Assignee: Resolution Bed, Inc., Dobson, NC (US)

( * ) Notice: Subject to any disclaimer, the term of this patent is extended or adjusted under 35 U.S.C. 154(b) by 65 days.

This patent is subject to a terminal disclaimer.

(21) Appl. No.: 16/468,471

(22) PCT Filed: Dec. 4, 2017

(86) PCT No.: PCT/US2017/064495
§ 371 (c)(1),
(2) Date: Jun. 11, 2019

(87) PCT Pub. No.: WO2018/111594
PCT Pub. Date: Jun. 21, 2018

(65) Prior Publication Data

US 2020/0078239 A1 Mar. 12, 2020

Related U.S. Application Data

(60) Provisional application No. 62/432,861, filed on Dec. 12, 2016.

(51) Int. Cl.
*A61G 7/015* (2006.01)
*A61G 5/00* (2006.01)
(Continued)

(52) U.S. Cl.
CPC ..... *A61G 7/015* (2013.01); *A61G 5/006* (2013.01); *A61G 7/002* (2013.01); *A61G 7/012* (2013.01);
(Continued)

(58) Field of Classification Search
CPC ..... A61G 7/015; A61G 7/018; A61G 7/0506; A61G 7/0513; A61G 7/05; A61G 7/16; A61G 7/012; A61G 7/002; A61G 5/006
See application file for complete search history.

(56) References Cited

U.S. PATENT DOCUMENTS 5,033,793 A * 7/1991 Quintile ..... A61G 5/1054 297/423.33
5,454,126 A * 10/1995 Foster ..... A61G 7/00 5/600
(Continued)

FOREIGN PATENT DOCUMENTS

EP 2465478 A1 6/2012

OTHER PUBLICATIONS

Communication with Supplementary European Search Report, EP Application No. 17882080.9, dated Dec. 5, 2019, 6 pp.
(Continued)

*Primary Examiner* — Nicholas F Polito
*Assistant Examiner* — Morgan J McClure
(74) *Attorney, Agent, or Firm* — Myers Bigel, P.A.

(57) ABSTRACT

A hospital bed includes a base, a lifting mechanism, a rotating frame configured to rotate horizontally relative to the base, and a patient support surface pivotally secured to the rotating frame. The patient support surface includes a back section, a seat section, and foot section that articulate relative to each other. The patient support surface translates from a bed configuration to a side-egress chair or stand assist configuration. The foot section includes first, second, and
(Continued)

third panels operably connected together and that are configured to move relative to each other in substantially parallel overlapping planes between an extended configuration when the patient support surface is in a bed configuration and a retracted configuration when the patient support surface is in a chair configuration. Contact of the foot section with a floor forces the first, second, and third panels to move to the retracted configuration.

16 Claims, 17 Drawing Sheets

(51) Int. Cl.

| | |
|---|---|
| ***A61G 7/05*** | (2006.01) |
| ***A61G 7/018*** | (2006.01) |
| ***A61G 7/002*** | (2006.01) |
| ***A61G 7/16*** | (2006.01) |
| ***A61G 7/012*** | (2006.01) |

(52) U.S. Cl.
CPC ..... *A61G 7/018* (2013.01); *A61G 7/05* (2013.01); *A61G 7/16* (2013.01)

(56) References Cited

U.S. PATENT DOCUMENTS 6,212,714 B1 * 4/2001 Allen ..... A61G 7/00 5/184
6,357,065 B1 * 3/2002 Adams ..... A47C 19/04 5/611
6,611,979 B2 * 9/2003 Welling ..... A61G 7/0528 5/624
6,792,633 B1 * 9/2004 Ito ..... A61G 5/006 5/618
7,458,119 B2 * 12/2008 Hornbach ..... A61G 7/002 5/600
8,286,282 B2 * 10/2012 Kummer ..... A61G 7/0527 5/615
8,887,329 B2 * 11/2014 Soltani ..... A61G 7/053 5/618
9,687,401 B2 * 6/2017 Alford ..... A63B 23/04
2002/0178502 A1 * 12/2002 Beasley ..... A61G 7/015 5/618
2005/0172405 A1 * 8/2005 Menkedick ..... A61G 7/005 5/618
2006/0021142 A1 * 2/2006 Hornbach ..... A61G 7/0509 5/600
2006/0053555 A1 3/2006 Poulos et al.
2006/0168728 A1 * 8/2006 Strobel ..... A61G 7/0507 5/618
2007/0136949 A1 * 6/2007 Richards ..... A61G 7/0514 5/600
2012/0066832 A1 * 3/2012 Poulos ..... A61G 7/053 5/83.1
2012/0153687 A1 * 6/2012 Kume ..... A61G 5/1067 297/118
2012/0198628 A1 * 8/2012 Richards ..... A61G 7/015 5/618
2016/0120717 A1 * 5/2016 Wurdeman ..... A61G 7/015 5/611

OTHER PUBLICATIONS

International Search Report and Written Opinion of the International Searching Authority, International Application No. PCT/US2017/064495, dated Feb. 14, 2018, 10 pp.
PBC Linear, Raise Quality and Lower Costs with Uni-guide. News Release [online] Sep. 16, 2008, Retrieved Jan. 20, 2018 from http://www.pbclinear.com/Download/PressRelease/Uni-guide.pdf.

* cited by examiner

HOSPITAL CHAIR BEDS WITH EXTENDABLE/RETRACTABLE FOOT SECTIONS

RELATED APPLICATION

This application claims the benefit of and priority to U.S. Provisional Patent Application No. 62/432,861 filed Dec. 12, 2016, the disclosure of which is incorporated herein by reference as if set forth in its entirety.

FIELD OF THE INVENTION

The present invention relates generally to the field of hospital beds and, more specifically, to hospital beds that are convertible into a chair configuration.

BACKGROUND

Conventional hospital beds are configured to provide a sufficiently comfortable support surface for patients in a supine position. In many cases, it is desirable for patients to elevate from a supine position to a sifting position in order to increase the activity of the circulatory and cardiovascular systems and/or in the course of medical treatment. In addition, patients may be interested in sitting up in bed to be more comfortable, for example, in order to read or meet with visitors. However, it may be difficult for some patients to get out of a hospital bed. As such, hospital beds that can be converted into chair-like configurations have been developed. In addition, hospital beds that can assist patients in moving from a supine position to a sitting position for the purpose of achieving a standing or walking position have also been developed.

SUMMARY

According to some embodiments of the present invention, a hospital bed that can be converted to a chair configuration includes a base having opposite end portions, a lifting mechanism secured to the base between the end portions, and a patient support surface pivotally secured to the lifting mechanism. The patient support surface is configured to support a mattress thereon. The lifting mechanism is configured to raise the patient support surface and mattress relative to the base to a stand-assist configuration to facilitate egress by a patient. A rotating frame is mounted on the lifting mechanism and is configured to rotate horizontally relative to the base. The patient support surface is movably (e.g., pivotally, etc.) secured to the rotating frame and the patient support surface is configured to translate from a bed configuration to a side-egress chair configuration.

The patient support surface can include a back section, a seat section, and a foot section that are configured to articulate relative to each other via one or more actuators. The patient support surface can be configured to translate from a bed configuration to a chair or stand assist configuration. The foot section includes first, second, and third panels operably connected together. The first and third panels can move relative to each other in a first plane, and the second panel can move in a second overlapping plane. The foot section is configured to engage a floor surface when the patient support surface is in a chair configuration, and engagement with the floor surface causes the first, second and third panels to move to the retracted configuration. In some embodiments, the foot section can include at least one roller or wheel that is configured to contact the floor surface and roll along the floor surface as the foot section is moved to the substantially orthogonal configuration relative to the seat section. The foot section can include one or more biasing members, such as springs, that are configured to urge the first, second and third panels to the extended configuration when the foot section is not engaged with the floor surface.

The panels of the foot section are supported by a frame assembly that includes a pair of spaced-apart base members secured to the second panel. The frame assembly also includes a pair of first rails and a pair of second rails. The first panel is secured to the pair of first rails and the third panel is secured to the pair of second rails. Each first rail is slidably secured to a first side of a respective base member and is movable relative to the base member between retracted and extended positions. Each second rail is slidably secured to a second side of a respective base member and is movable relative to the base member between retracted and extended positions. In some embodiments, each first and second rail includes a pair of elongate spaced-apart rods. Each rod slidably cooperates with a respective passageway in a receptacle associated with each base.

In some embodiments, a first biasing member is connected to each first rail and a respective base member and is configured to urge the first rail to the extended position relative to the respective base member. A second biasing member is connected to each second rail and a respective base member and is configured to urge the second rail to the extended position relative to the respective base member. In some embodiments, the first and second biasing members are elongated coil springs.

According to other embodiments of the present invention, a method of translating a hospital bed to an egress configuration includes articulating back, seat and foot sections of a patient support surface relative to each other from a substantially co-planar configuration to a chair configuration. The foot section includes first, second and third panels that are configured to move relative to each other in substantially parallel overlapping planes between an extended configuration when the patient support surface is in a bed configuration and a retracted configuration when the patient support surface is in a chair configuration. The foot section contacts a floor surface to cause the panels to move to the retracted configuration. Contacting the floor surface with the foot section causes the first and third panels to move relative to each other in a first one of the planes, and causes the second panel to move in a second one of the planes. In some embodiments, the back, seat and foot sections are rotated 90 degrees to a side egress position prior to contacting the floor surface with the foot section.

In some embodiments, some of the foot section panels can include one or more mattress support members. As the foot section panels are moved to a retracted configuration, the mattress support members move closer together thereby causing a portion of a mattress secured thereto to move to a retracted configuration.

It is noted that aspects of the invention described with respect to one embodiment, may be incorporated in a different embodiment although not specifically described relative thereto. That is, all embodiments and/or features of any embodiment can be combined in any way and/or combination. These and other objects and/or aspects of the present invention are explained in detail in the specification set forth below.

BRIEF DESCRIPTION OF THE DRAWINGS

The accompanying drawings, which form a part of the specification, illustrate embodiments of the present invention. The drawings and description together serve to fully explain the invention.

FIG. 10A illustrates the various cutouts and apertures in the panels that facilitate movement of the panels between extended and retracted configurations, and also illustrates mattress support members secured to the panels.

FIG. 11D illustrates the springs in an extended configuration wherein a force is applied by the springs to the panels so as to urge the panels back to the extended configuration of FIG. 11C.

DETAILED DESCRIPTION

Figure 1:
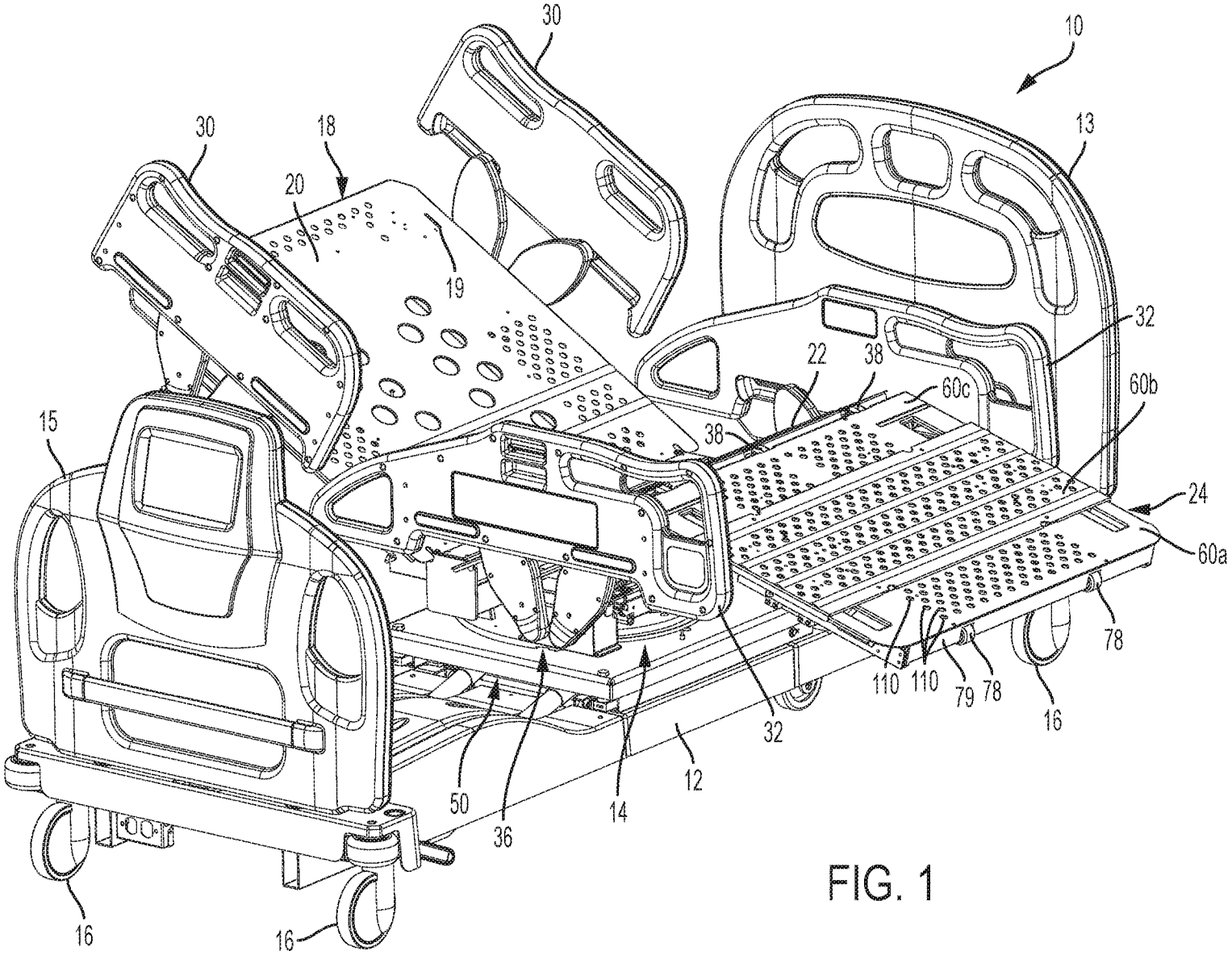
FIG. 1 is a top perspective view of a hospital chair bed in a chair configuration (side egress) and having an extendable/retractable foot section, shown in an extended configuration, according to some embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity, and broken lines may illustrate optional features or elements unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second are used herein to describe various features or elements, these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "about", as used herein with respect to a value or number, means that the value or number can vary by +/−twenty percent (20%).

The term "rod", as used herein, broadly refers to and includes various types of mechanical connectors or links, such as pins, bars, plates, etc.

The term "substantially orthogonal", as used herein, means+/−thirty degrees (30°) relative to vertical.

As used herein, the terms "comprise", "comprising", "comprises", "include", "including", "includes", "have", "has", "having", or variants thereof are open-ended, and include one or more stated features, integers, elements, steps, components or functions but does not preclude the presence or addition of one or more other features, integers, elements, steps, components, functions or groups thereof. Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

Figure 2:
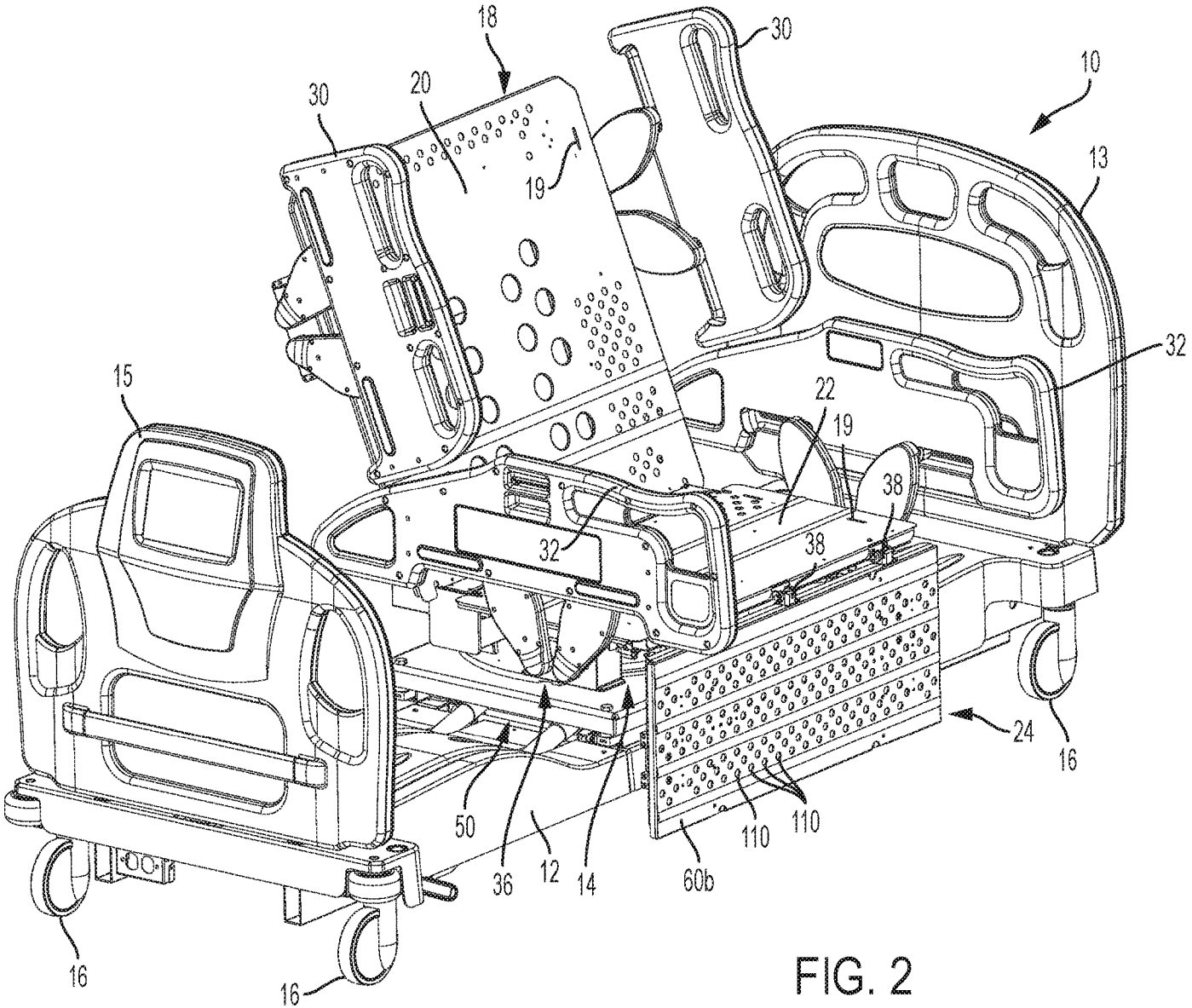
FIG. 2 is a top perspective view of the hospital chair bed of FIG. 1 with the extendable/retractable foot section shown in a retracted configuration, according to some embodiments of the present invention.

Referring to FIGS. 1-2, a hospital bed 10, according to some embodiments of the present invention, is illustrated. The illustrated bed 10 has a base 12 and a rotating frame 14 mounted on the base 12. The frame 14 is configured to rotate relative to the base 12 to facilitate side egress from the bed 10 by a patient, as will be described below. Casters 16 are mounted to the four corners of the base 12 and facilitate movement of the bed 10 about the hospital or other environment. In some embodiments, casters 16 are locking casters that can be selectively locked to prevent movement of the bed 10.

The illustrated bed 10 has a patient support surface 18 configured to support a mattress M (FIG. 9) on which a patient can be situated. A portion of the mattress M may be attached to the patient support surface 18 via a plurality of straps (e.g., nylon webbing straps, etc.) attached to the mattress ticking. The straps can extend down through various respective slots 19 formed in the patient support surface 18, and can be fastened via connectors under the patient support surface 18. Exemplary connectors are "D" rings. However, various types of connectors and various ways of securing a mattress to the patient support surface 18 can be utilized, without limitation. As will be described below, a portion of the mattress M overlying the foot section 2 can be secured to the patient support surface 18 via mattress support members 100 (FIG. 7) secured to one or more of the panels **60*a*-60*c* of the foot section 24**.

The patient support surface 18 is supported by the rotating frame 14 and includes a back section 20, a seat section 22, and a foot section 24. The back section 20, seat section 22 and foot section 24 can articulate with respect to each other and can be serially hinged or otherwise movably secured together, as illustrated. The back section 20 and seat section 22 can be pivotally attached to each other by pins, hinges, or other suitable mechanisms well known in the art. The seat section 22 and foot section 24 can also be pivotally attached to each other by pins, hinges, or other suitable mechanisms well known in the art.

In some embodiments, the hospital bed 10 may have a patient support surface 18 that can be articulated into a chair configuration without rotating to a side egress position. For example, the patient support surface 18 articulates as described herein to a chair or stand assist configuration such that a patient can egress from the foot of the bed 10.

A mattress M (FIG. 9) supported by the patient support surface 18 may have a foot portion that can retract when the hospital chair bed 10 is moved from a bed configuration to a chair or stand assist configuration and the foot section 24 of the patient support surface 18 moves to a retracted configuration as described below. Various types of retractable mattresses are described in U.S. Pat. No. 8,495,774, which is incorporated herein by reference in its entirety. The mattress foot portion can be attached to the foot section 24 of the patient support surface 18 via mattress support members 100 (FIGS. 9, 10A-10B), as described below.

Still referring to FIGS. 1-2, the illustrated bed 10 also has a first set of patient side rails 30 typically secured to the back section 20 in spaced-apart relationship and a second set of patient side rails 32 typically secured to the seat section 22 and/or foot section 24 in spaced-apart relationship, as illustrated. A head board 13 is secured to the base 12 at the head end of the bed 10 and a foot board 15 is secured to the base 12 at the foot end of the bed 10, as would be understood by those skilled in the art.

The patient support surface 18 can be secured to the rotating frame 14 in various ways, for example via one or more of a transverse rod or pin connection 36 to facilitate tilting of the patient support surface 18 relative to the rotating frame 14. The rotating frame 14 can be secured to the base 12 via a lift mechanism 50, such as a double scissors lift, etc. The lift mechanism 50 is configured to raise and lower the patient support surface 18, via the rotating frame 14, relative to the base 12. The lift mechanism 50 can be driven by hydraulic cylinders, air cylinders, air bags, and/or electrical or electromechanical devices, etc. The lift mechanism 50 can be configured to allow the patient support surface 18 to be raised relatively high relative to the base 12 and to be lowered relatively low with respect to the base 12, as described above. See, e.g., U.S. Pat. No. 7,788,748 for examples of rotational and lift components, which is incorporated herein by reference in its entirety.

The foot section 24 may also be referred to as a "leg" section. Thus, the terms "foot section" and "leg section" are used interchangeably herein. The foot section 24 is pivotally connected to the seat section 22 of the articulating patient support surface 18, for example, via one or more hinges 38 (FIGS. 3-8).

Referring now to FIGS. 3-8, 10A-10B and 11A-11D, the illustrated foot section 24 can include a plurality of panels 60*a*, 60*b*, 60*c* that are configured to move relative to each other in substantially parallel overlapping planes between an extended configuration (FIGS. 3, 5, 6 and 11C) and a retracted configuration (FIGS. 4, 7, 8, 10B and 11D) when the patient support surface 18 is in an egress chair configuration. The panels 60*a*-60*c* are in the retracted configuration in FIGS. 7 and 8 for illustrative purposes although foot section 24 is in a parallel plane to the seat section 22 so that the patient support surface 18 is not in a chair configuration. The free end of the foot section 24 is configured to engage a floor surface F (FIGS. 3 and 4) when the patient support surface 18 is in a chair configuration, and the engagement with the floor surface F causes the plurality of panels 60*a*-60*c* to move to the retracted configuration, as described further below.

The illustrated panels 60*a*-60*c* have a generally rectangular, planar configuration, although other shapes and configurations are possible. In addition, the illustrated panels 60*a*-60*c*, as well as the back and seat sections of the patient support surface 18, include a plurality of apertures 110 formed therein. These apertures 110 are utilized to reduce the overall weight of the various panels.

The illustrated foot section 24 includes a frame assembly 70 (FIG. 6) upon which the panels 60*a*-60*c* are mounted. The illustrated frame assembly 70 includes a pair of spaced-apart base members 72 secured to the underside of the second panel 60*b*, a pair of first elongate arms or rails 74 secured to the underside of the first panel 60*a*, and a pair of second elongate arms or rails 76 secured to the underside of the third panel 60*c*. Each first rail 74 is slidably secured to one side 72*a* of a respective base member 72 and is movable relative to the base member 72 between retracted and extended positions. Each second rail 76 is slidably secured to an opposite side 72*b* of a respective base member 72 and is movable relative to the base member 72 between retracted and extended positions. The pair of first rails 74 and the pair of second rails 76 are illustrated in their respective extended positions in FIG. 6, and are illustrated in their respective retracted positions in FIG. 8.

Figure 12:
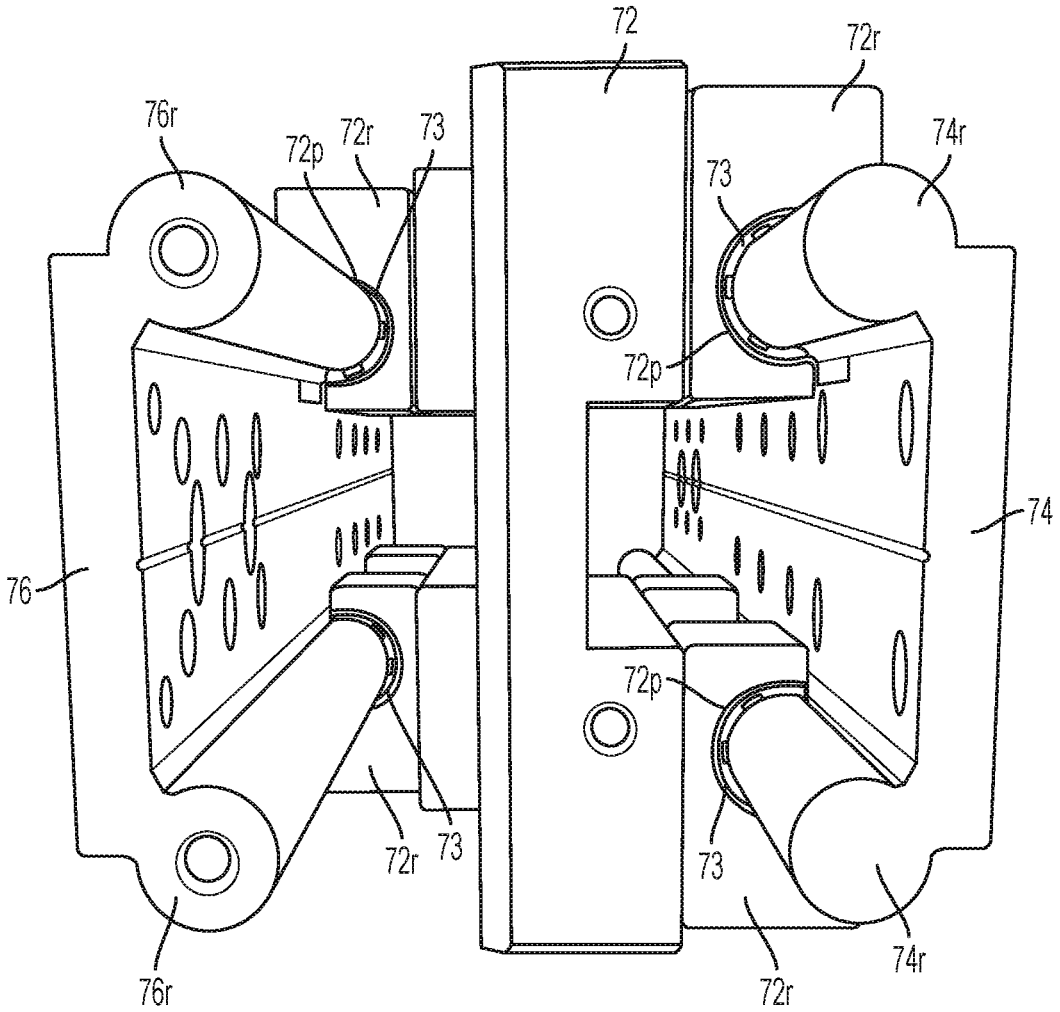
FIG. 12 is an end view of one of the base members and illustrating first and second rails slidably secured to respective opposite sides of the base.
Figure 13:
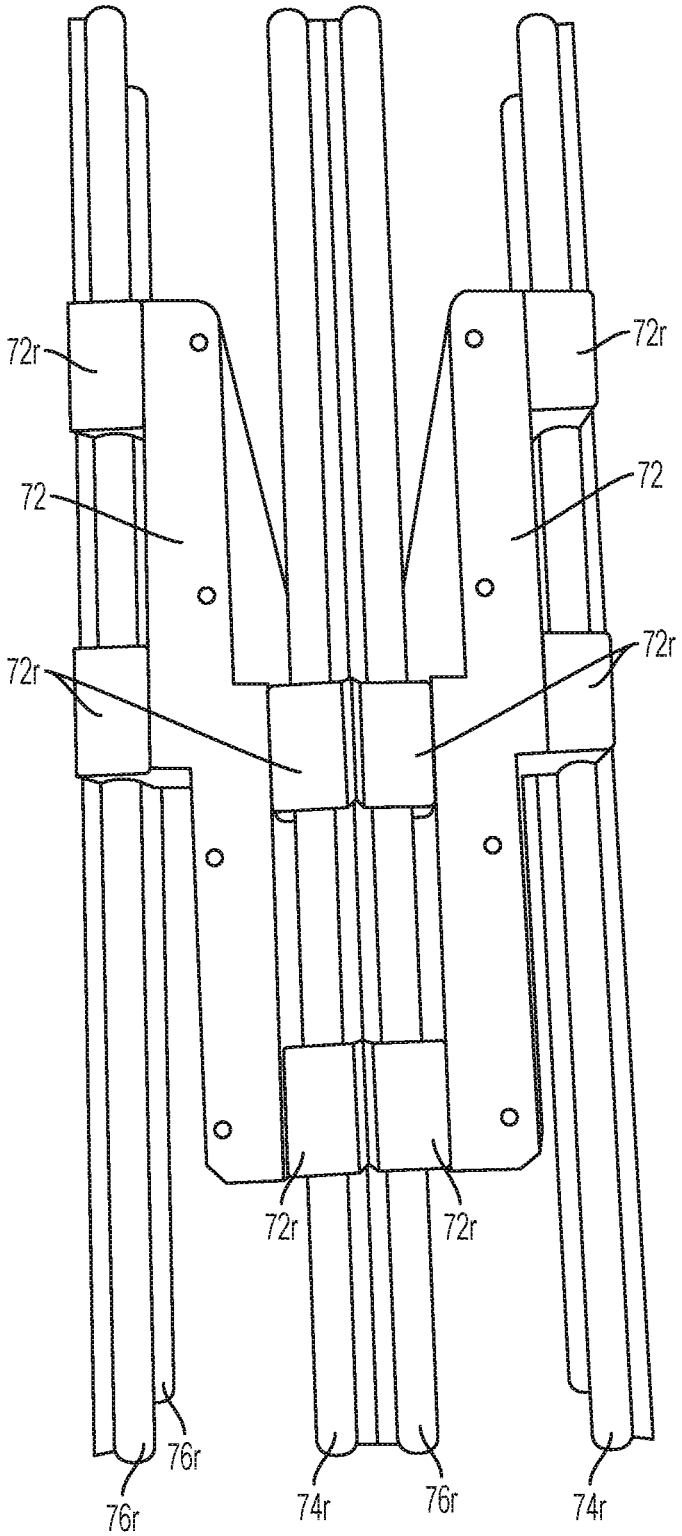
FIG. 13 is a top plan view of the base members and respective first and second rails slidably attached thereto.

Referring to FIGS. 12 and 13, each of the first and second rails 74, 76 includes a pair of elongate, spaced-apart rods 74*r*, 76*r* that extend along the length of each rail 74, 76. In the illustrated embodiment, the rods 74*r*, 76*r* have a somewhat tubular configuration (FIG. 12). Each rod 74*r*, 76*r* slidably cooperates with a pair of spaced-apart receptacles 72*r* in each base 72. Each receptacle 72*r* includes a rounded bore or passageway 72*p* formed therein that is adapted to receive a respective rod 74*r*, 76*r*. As illustrated in FIG. 12, each rod 74*r*, 76*r* is attached to a respective rail 74, 76 along a length thereof such that each rod 74*r*, 76*r* has a rounded cross-sectional configuration that allows each rod 74*r*, 76 to be inserted within a respective passageway 72*p*. The configuration of each passageway 72*p* and each rod 74*r*, 76*r* is such that each rod 74*r*, 76*r* can slide lengthwise along a respective passageway 72*p* yet be retained within each passageway 72*p*. In other words, the cross-section of each rod 74*r*, 76*r* has a circumference of greater than one hundred eighty degrees (180°) and each passageway 72*p* has a circumference of greater than one hundred eighty degrees (180°) such that a rod 74*r*, 76*r* is retained within a respective passageway 72*p*. In the illustrated embodiment, a journal bearing 73 is positioned within each passageway 72*p* that facilitates sliding of the rods 74*r*, 76*r* within the passageways 72*p*.

Each of the two first rails 74 has an end portion 74*a* secured to the first panel 60*a* via bracket B1 and each of the two second rails 76 has an end portion secured to the third panel 60*c* via bracket B2. Each of the two first rails 74 has an opposite end portion 74*b* secured to a respective base 72 and each of the two second rails 76 has an opposite end portion 76*b* secured to a respective base 72.

Referring to FIGS. 11A-11D, each rail 74, 76 is operably associated with one or more biasing members or springs 120 that are configured to urge the first and second rails 74, 76 outwardly from the base member 72 in opposing directions from each other to an extended position. In the illustrated embodiment, each biasing member 120 is an elongated coil spring, although other types of springs may be utilized.

In the illustrated embodiment, one end 120*a* of a spring 120 is connected to a bracket 122 that is attached to the end 74*b* of rail 74, and the opposite end 120*b* of the same spring 120 is attached to a bracket 124 secured to the base 72. One end 120*a* of another spring 120 is connected to a bracket 122 that is attached to the end 76*b* of rail 76, and the opposite end 120*b* of the same spring 120 is attached to a bracket 124 secured to the base 72. The brackets 122, 124 may be secured to the rails 74, 76 and base 72 in various ways, without limitation, for example via fasteners, such as bolts, rivets, etc. and/or via welding.

Figure 11A:
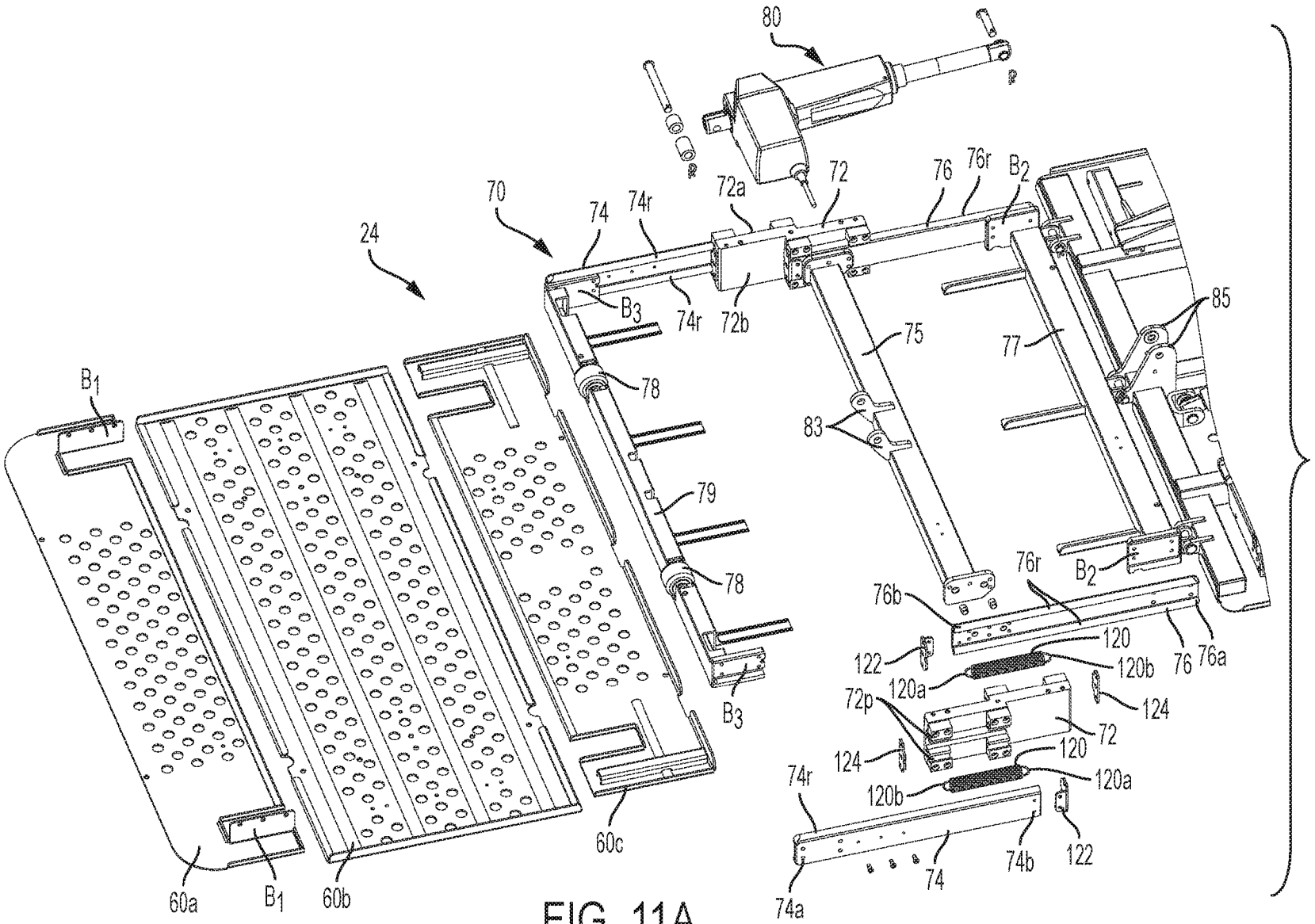
FIG. 11A is an exploded view of the foot section illustrated in FIG. 6.
Figure 11B:
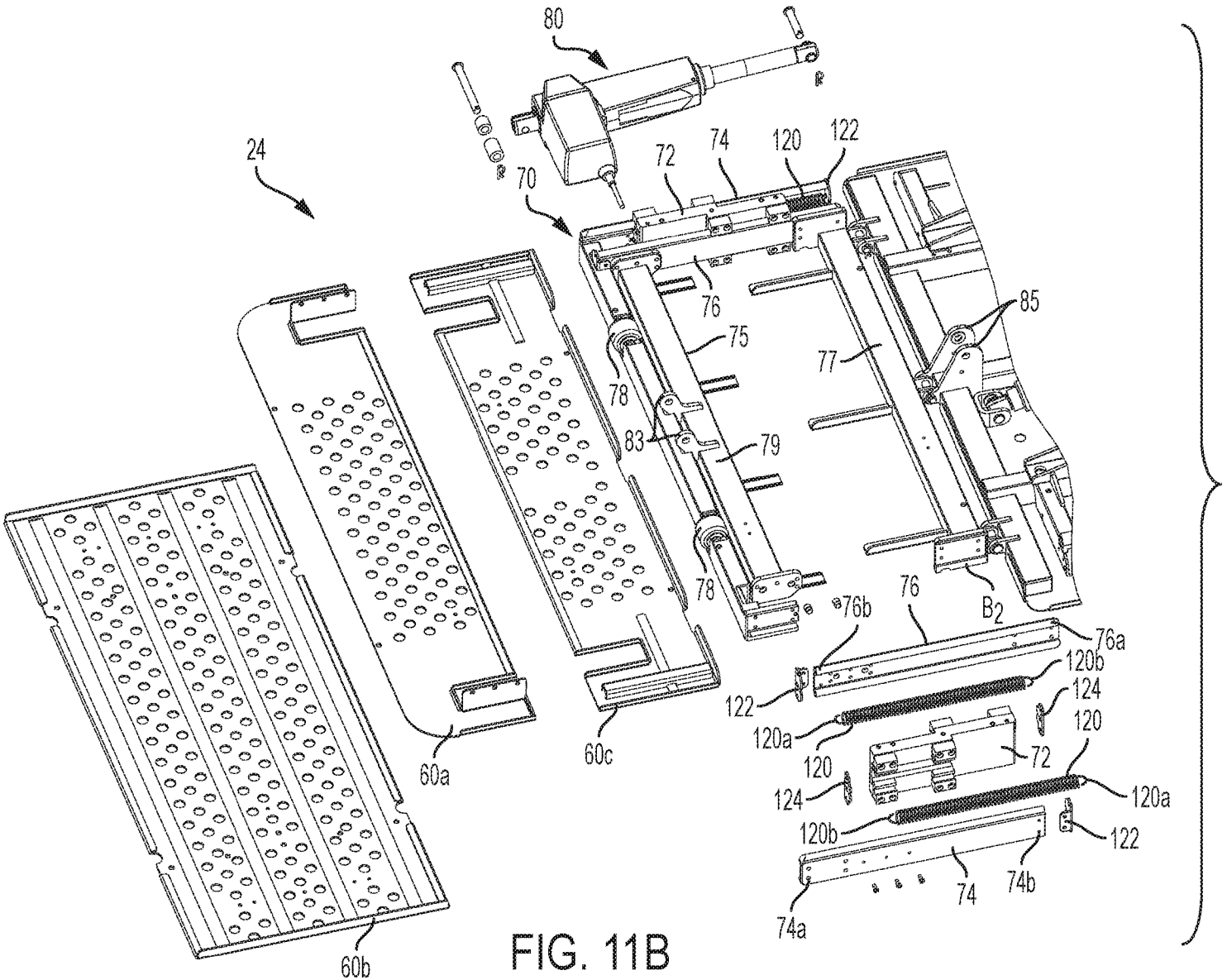
FIG. 11B is an exploded view of the foot section illustrated in FIG. 8.
Figure 11C:
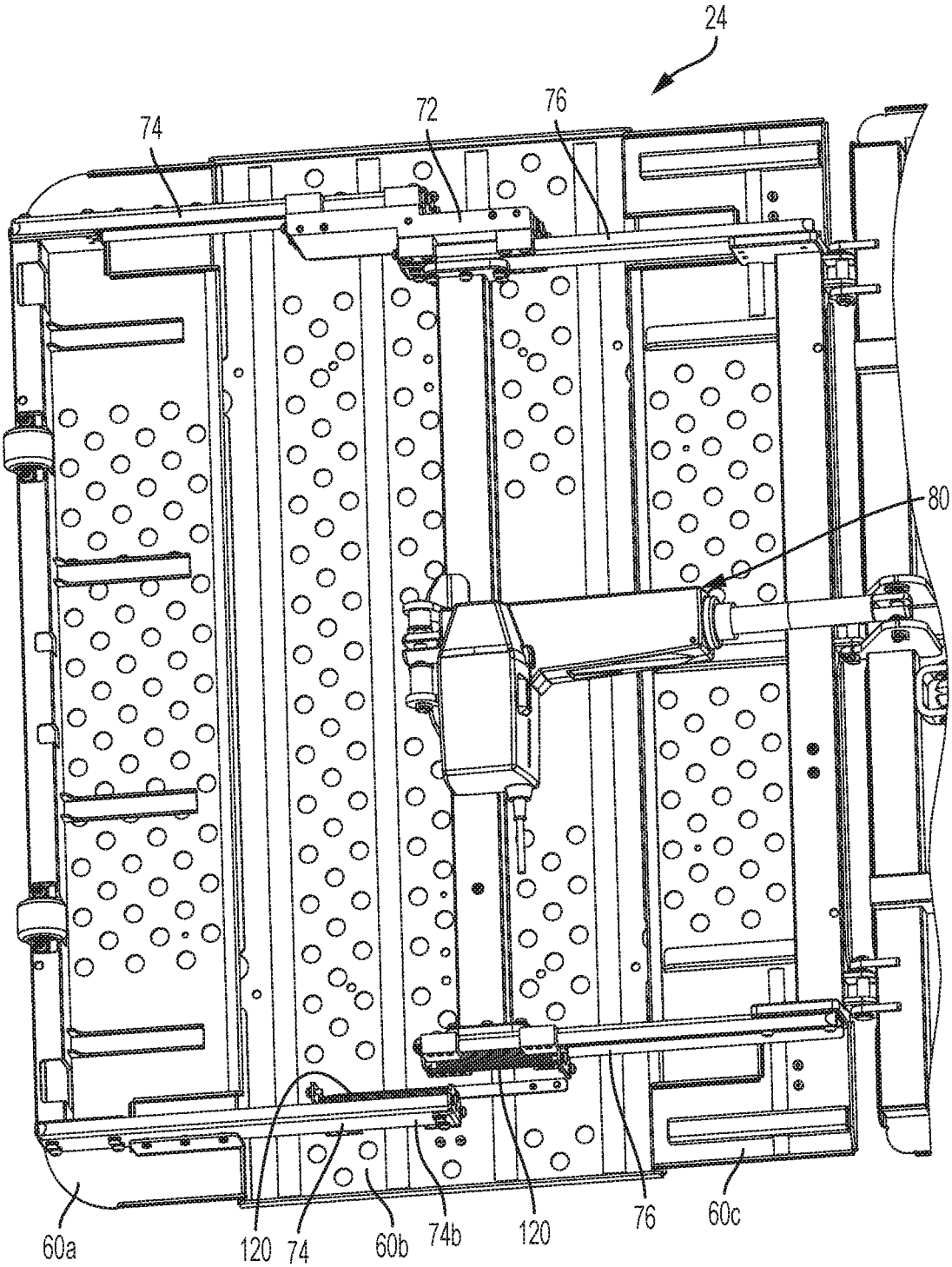
FIG. 11C is a bottom perspective view of the foot section of the hospital chair bed of FIG. 1 illustrating the foot section in an extended configuration and also illustrating portions of one of the base members removed to reveal a pair of springs that are configured to urge the first, second and third panels to the extended configuration.
Figure 11D:
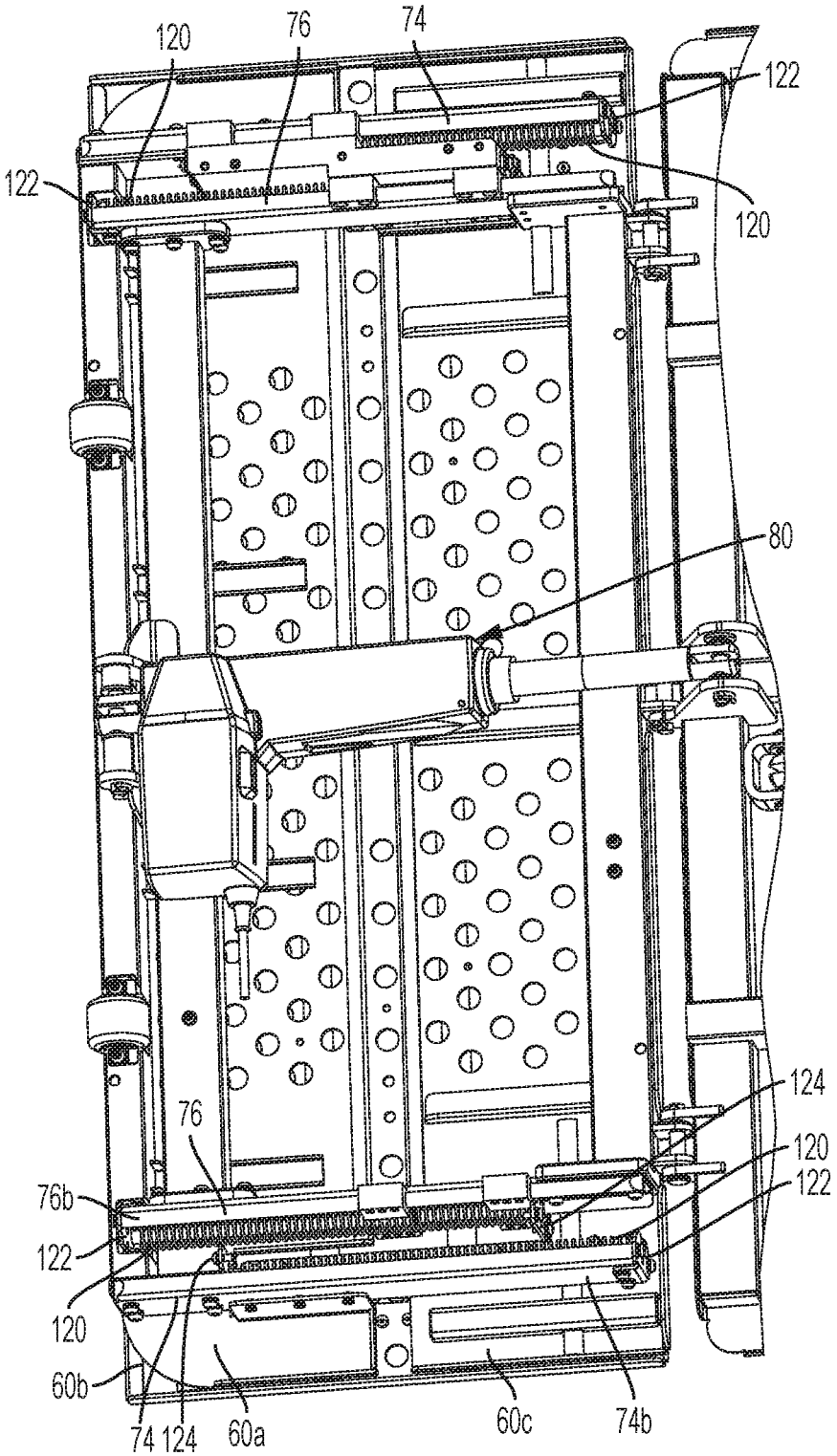
FIG. 11D illustrates the foot section of FIG. 11C after being moved to a retracted configuration.

When the panels 60*a*, 60*b*, 60*c* are move to the retracted position as a result of contact of the foot section 24 with a floor surface F, the springs 120 are extended as a result of the movement of the rails 74, 76, as illustrated in FIG. 11D. For example, rail 74 is moved such that end 74*b* and bracket 122 secured thereto moves away from bracket 124 secured to the base 72 thereby extending a spring 120 attached to the brackets 122, 124, and rail 76 is moved such that end 76*b* and bracket 122 secured thereto moves away from bracket 124 secured to the base 72 thereby extending a spring 120 attached to the brackets 122, 124.

The extension of the springs 120 causes the panels 60*a*-60*c* to be urged back to the extended position when the foot section 24 is no longer contacting a floor F. For example, when the patient support surface 18 is articulated from a chair configuration back to a bed configuration and the foot section is lifted away from a floor F, the springs 120 are free to return to a non-extended position thereby urging the panels 60*a*-60*c* of the foot section 24 to the extended configuration.

The illustrated frame assembly 70 also includes a first cross member 75 that extends between and is secured to the two base members 72, a second cross member 77 that extends between and is secured to the two brackets B2, and a third cross member 79 that extends between the two first rails 74. The third cross member 79 is secured to the first end 74*a* of each of the two first rails 74 via respective brackets B3 and forms the outer or free end of the foot panel 60*a*. The first, second and third cross members 75, 77, 79 provide stability to the frame assembly 70.

Figure 7:
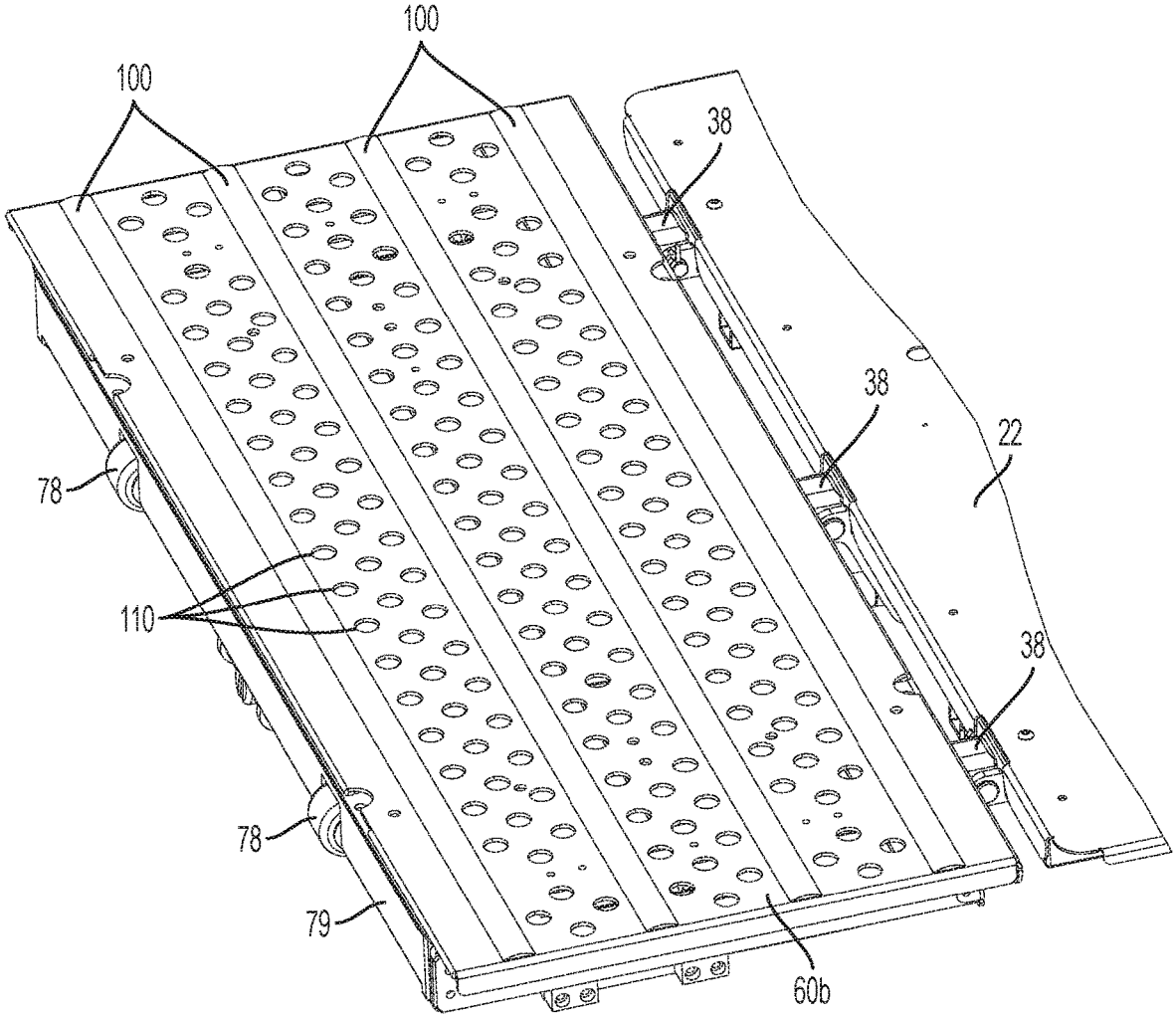
FIG. 7 is a top view of the foot section of the hospital chair bed of FIG. 1 illustrating the foot section in a retracted configuration.
Figure 8:
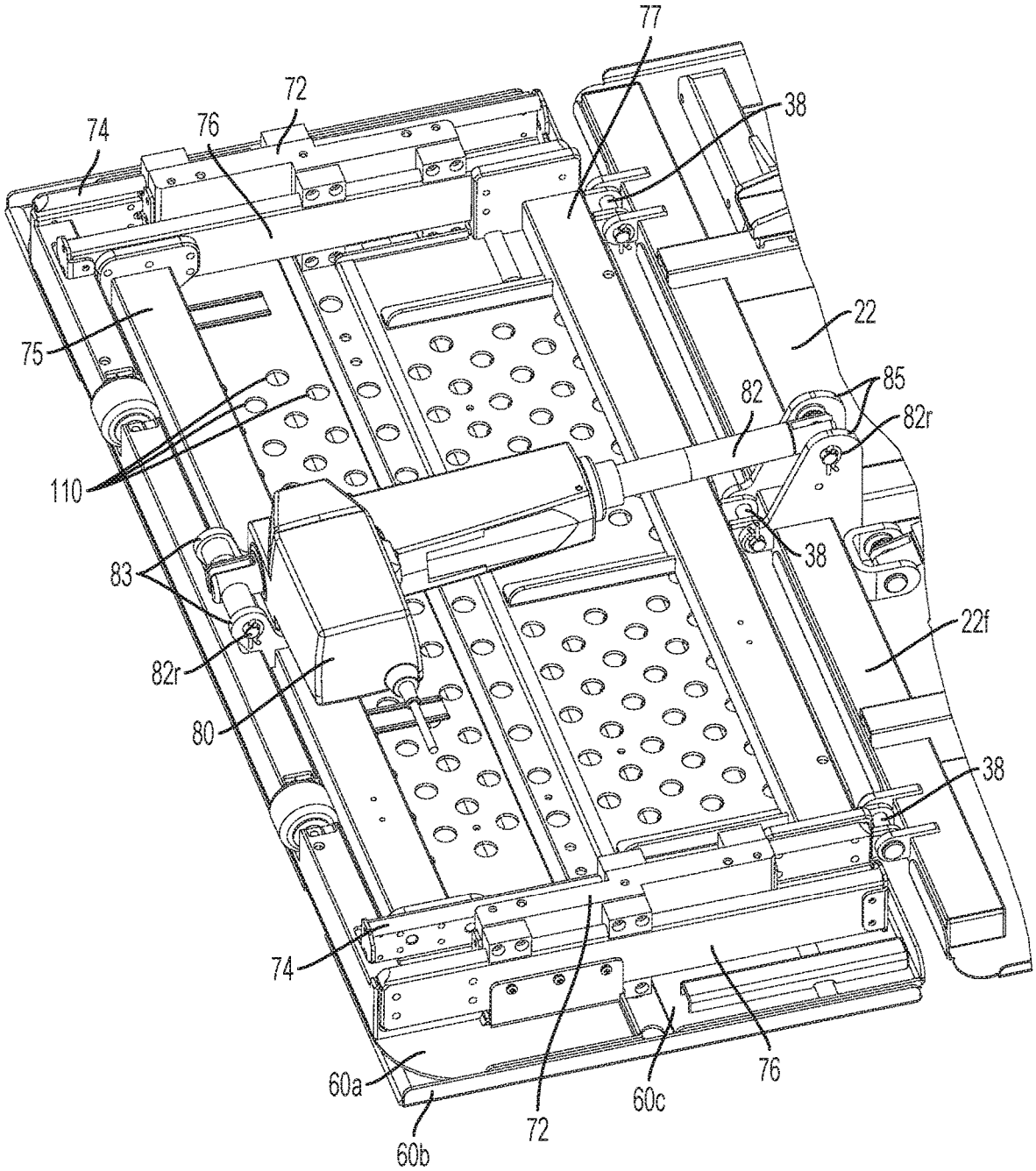
FIG. 8 is a bottom perspective view of the foot section of the hospital chair bed of FIG. 1 illustrating the foot section in a retracted configuration.

The first panel 60*a* is secured to the two first rails 74, the second panel 60*b* is secured to the two base members 72, and the third panel 60*c* is secured to the two second rails 76. This configuration allows the first and third panels 60*a*, 60*c* to slide towards each other beneath the second panel 60*b* when the foot section is moved to the retracted position, as illustrated in FIGS. 7, 8 and 11D. When the foot section 24 is in the retracted position, the first and third panels 60*a*, 60*c* are in adjacent, substantially co-planar relationship and the second panel 60*b* overlies the first and third panels 60*a*, 60*c*.

In the illustrated embodiment, as the first and second rails 74, 76 are moved between extended and retracted positions, the first and third panels 60*a*, 60*c* move relative to each other in a first plane, and the second panel 60*b* is static or moves in a second plane that is substantially parallel with the first plane. When viewed from above the foot section 24 (FIGS. 5 and 7), the second panel 60*b* is in a second plane that overlaps the first plane. When viewed from below the foot section 24 (FIGS. 6 and 8) the first and third panels 60*a*, 60*c* move relative to each other in the first plane that overlaps the second plane.

Figure 6:
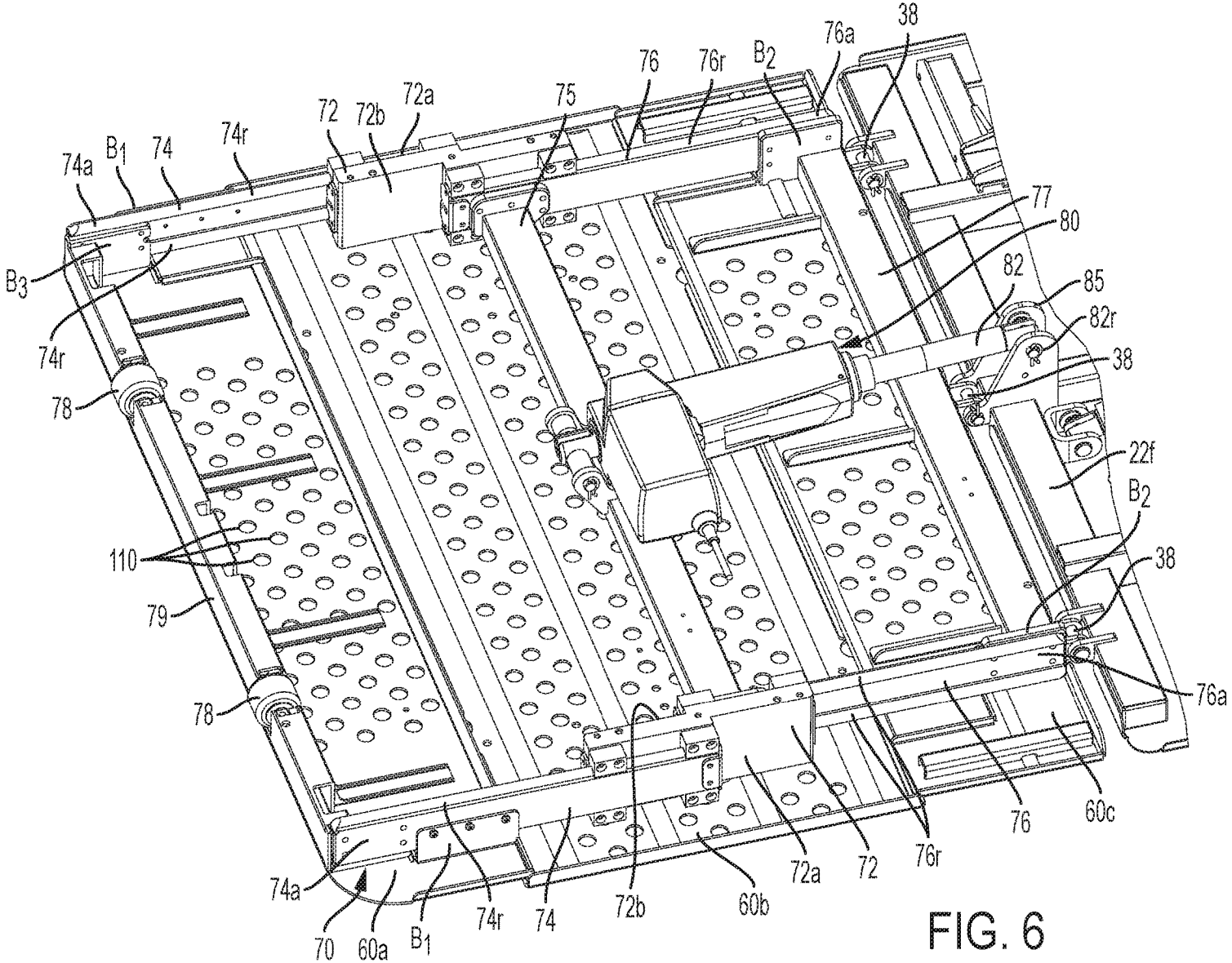
FIG. 6 is a bottom perspective view of the foot section of the hospital chair bed of FIG. 1 illustrating the foot section in an extended configuration.

Referring to FIGS. 6 and 8, an actuator 80 can be utilized to move the foot section 24 between a substantially co-planar configuration relative to the seat section 22 and a substantially orthogonal configuration relative to the seat section 22. The illustrated actuator 80 is secured to the first cross member 75 of the frame assembly 70 via a pin, bolt or other fastener 82*r* that engages bracket 83 extending from the first cross member 75, as would be understood by one skilled in the art. A cotter pin may be utilized to retain the fastener 82*r* within the bracket 83. The actuator 80 also includes a piston rod 82 that is attached to the frame 22*f* of the seat section 22 via a bolt or other fastener 82*r* that engages bracket 85, as would be understood by one skilled in the art. The actuator 80 may be any of various types of actuators (e.g., an electrical actuator, pneumatic or hydraulic cylinders, or other suitable electromechanical devices, etc.).

Figure 3:
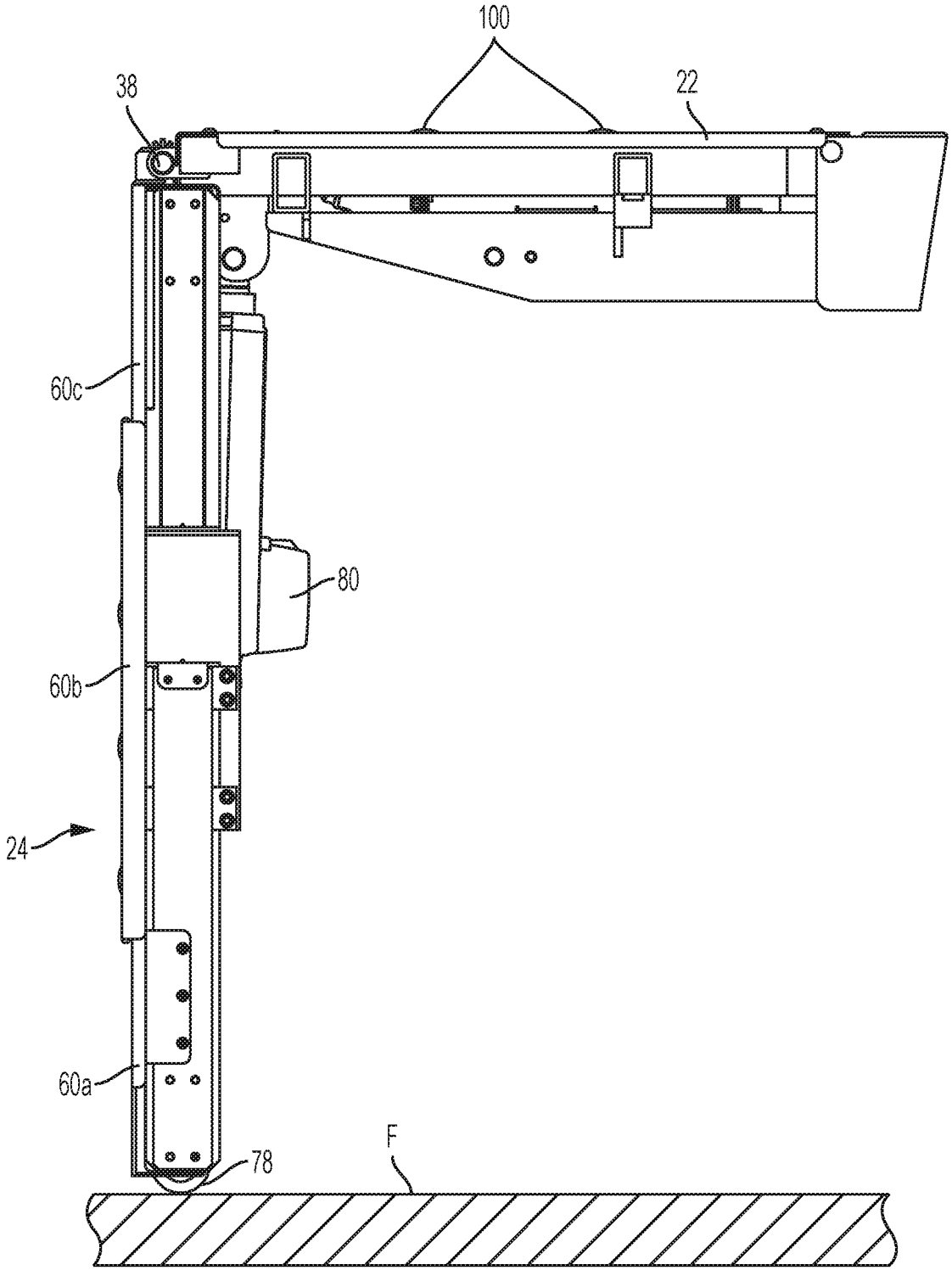
FIG. 3 is a partial side view of the hospital chair bed of FIG. 1 illustrating the hospital chair bed in a chair configuration with the foot section in an extended configuration.
Figure 4:
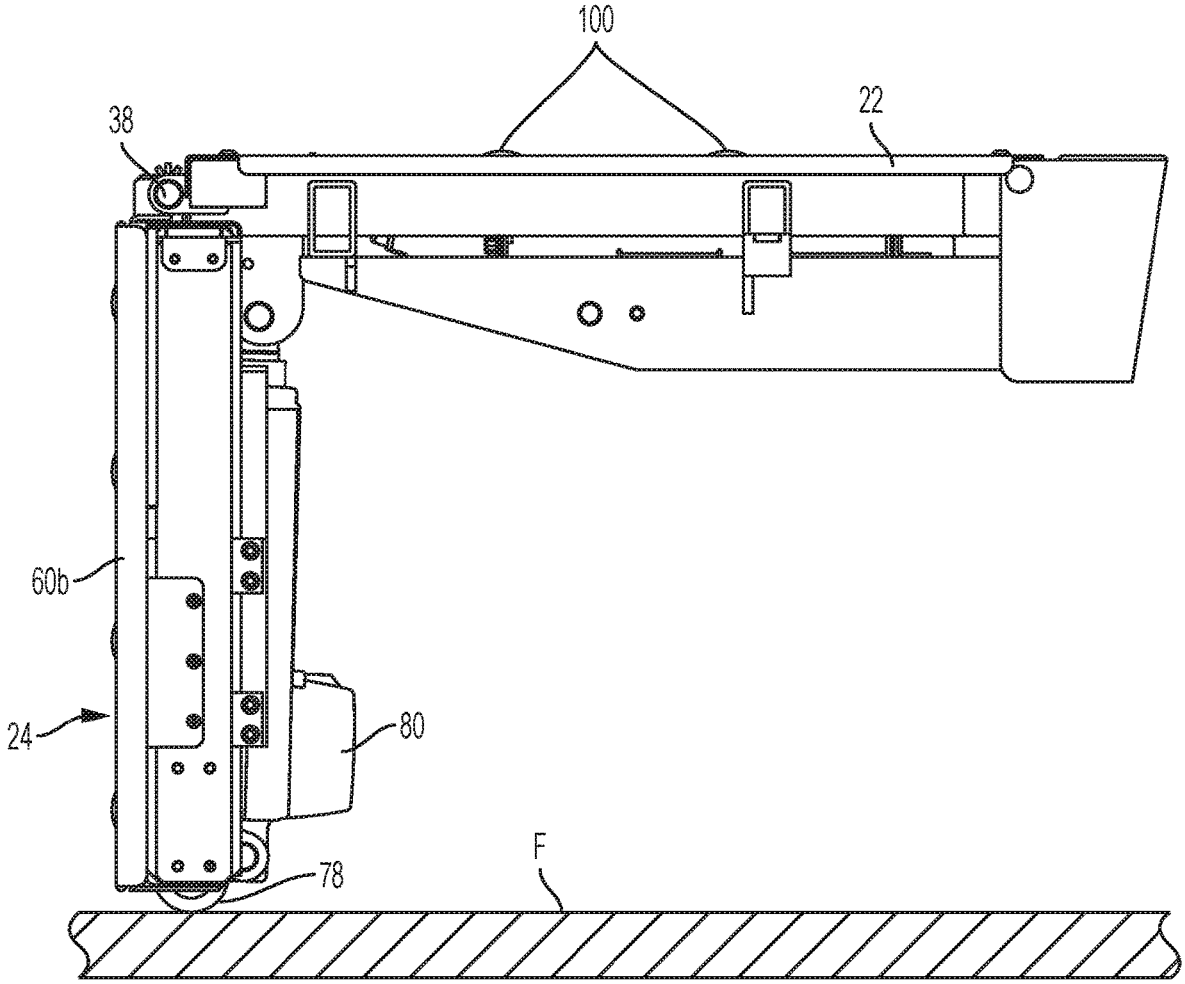
FIG. 4 is a partial side view of the hospital chair bed of FIG. 1 illustrating the hospital chair bed in a chair configuration with the foot section in a retracted configuration.
Figure 5:
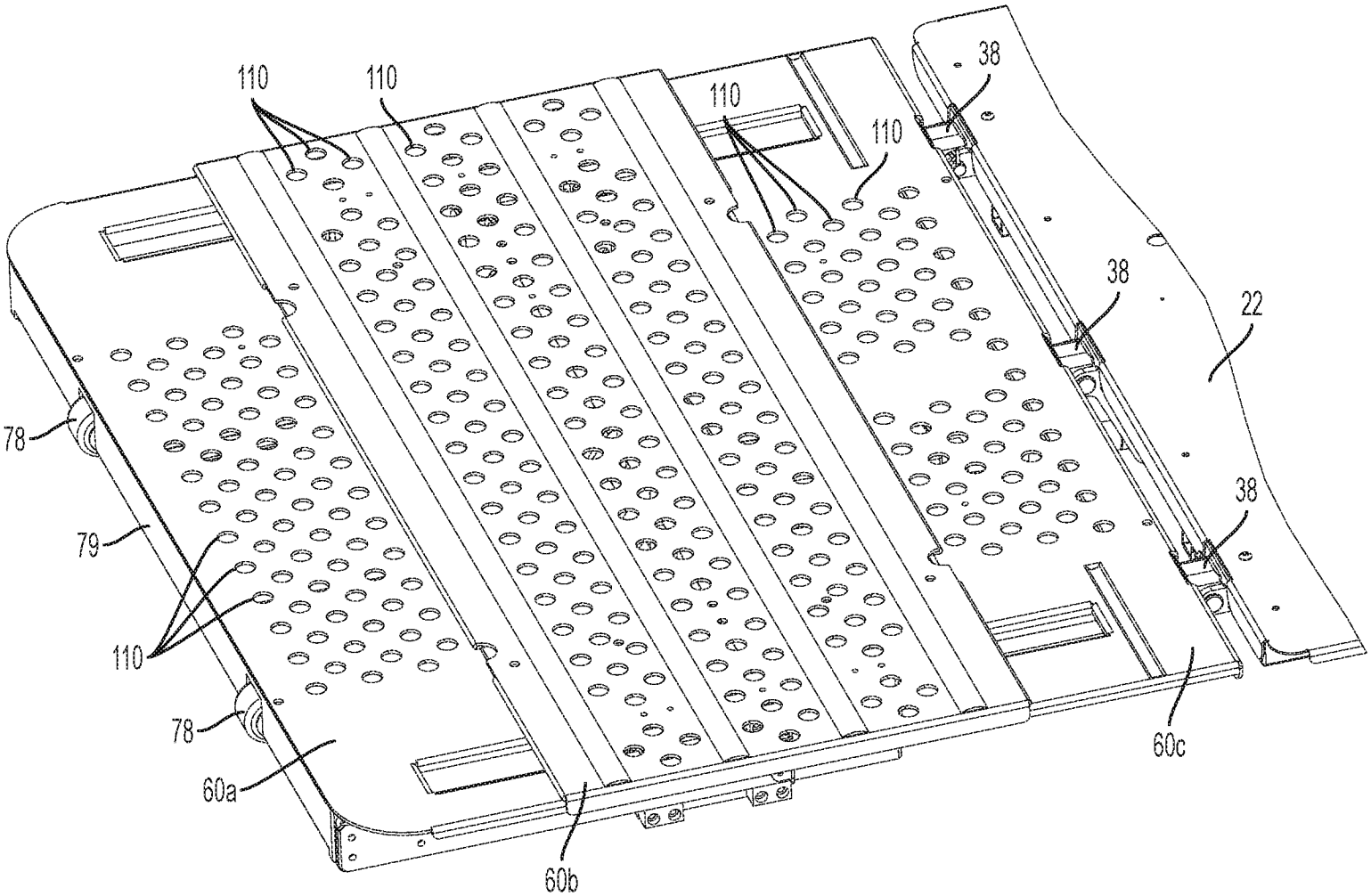
FIG. 5 is a top view of the foot section of the hospital chair bed of FIG. 1 illustrating the foot section in an extended configuration.

Referring to FIGS. 3-8, the frame assembly 70 of the illustrated foot section 24 includes at least one roller or wheel 78, shown as a plurality of spaced apart rollers/wheels, that are rotatably secured to the third cross member 79 of the frame assembly 70. These wheels 78 are configured to contact a floor surface F and roll along the floor surface F as the foot section 24 is moved to the substantially orthogonal configuration relative to the seat section 22 via the actuator 80 in either a side egress or end egress configuration. The engagement of the wheels 78 with the floor surface F causes the first and second rails 74, 76 to move to respective retracted positions, thereby causing the panels 60*a*-60*c* to move to the retracted configuration as illustrated in FIG. 4.

In some embodiments, the articulated patient support surface 18 can be rotated in an elevated configuration to a side egress position with the foot section 24 articulated down relative to the seat section 22 and with the foot section 24 in the extended configuration (FIG. 3). By lowering the patient support surface 18 via the lift mechanism 50, the foot section 24 contacts the floor surface and moves to a retracted configuration (FIG. 4).

In operation, the bed 10 can have the back section 20, seat section 22, and foot section 24 in a horizontal configuration, to support a patient in a supine position. To convert the bed 10 to a chair configuration, the back section 20, seat section 22 and foot section 24 articulate relative to each other as shown in FIG. 1, by actuators (e.g., pneumatic or hydraulic cylinders or other suitable electrical devices or electromechanical devices). For example, an actuator (not shown) can be utilized to pivot the back section 20 upwardly relative to the seat section 22. Another actuator 80 can be configured to pivot the foot section 24 relative to the seat section 22, as described above.

The transformation to a chair configuration can be carried out so that, the back section 20 and seat section 22 can be pivoted relative to each other (FIG. 1) and the foot section 24 and seat section 22 are at least somewhat pivoted relative to each other (FIG. 1). The articulated patient support surface 18 can be rotated approximately ninety degrees (90°) to permit side egress from the bed 10, as illustrated in FIG. 1.

Figure 10A:
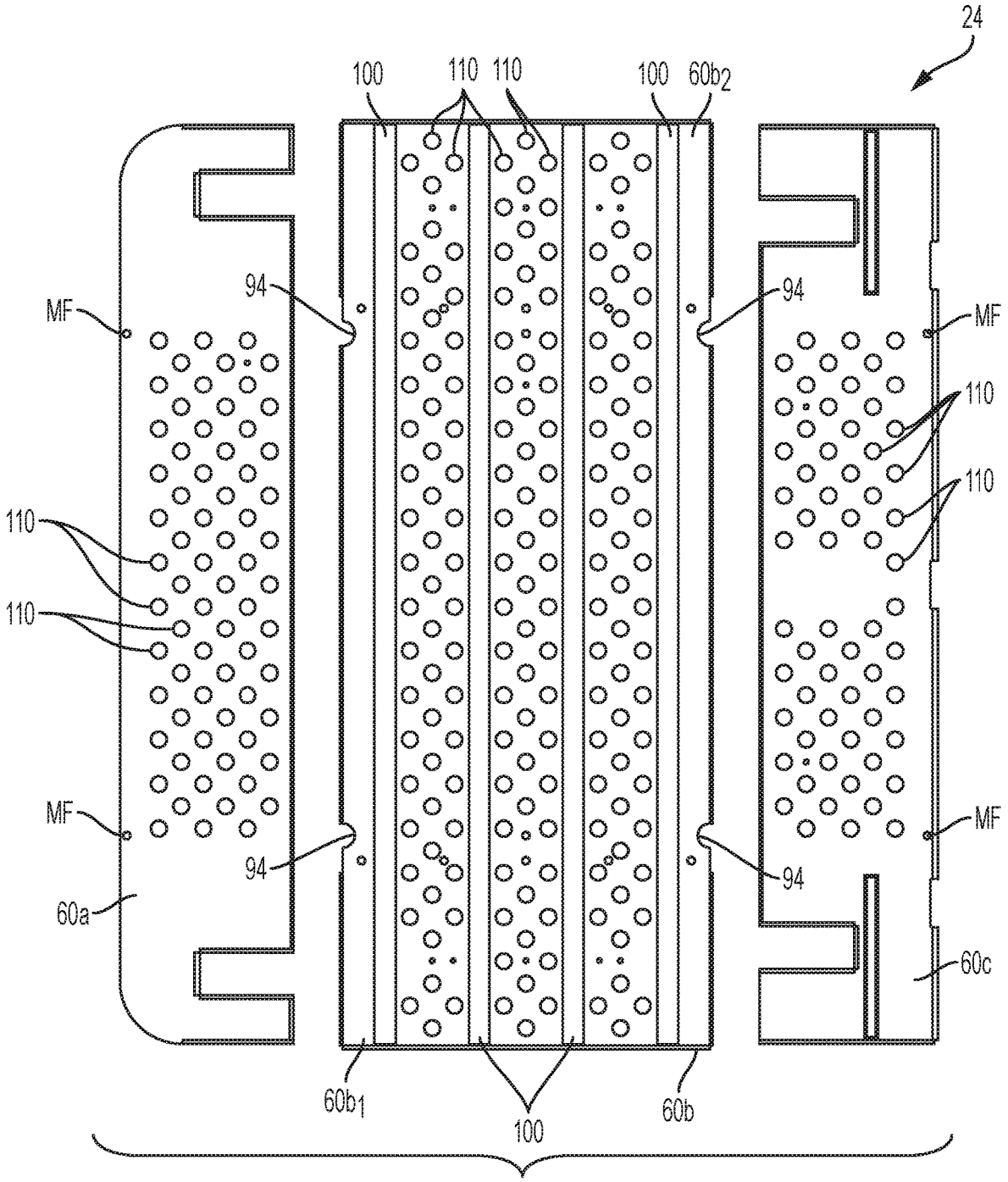
FIG. 10A is a top plan view of the foot section of FIG. 5 with the panels thereof in an extended configuration and without the other components of the foot section for clarity.
Figure 10B:
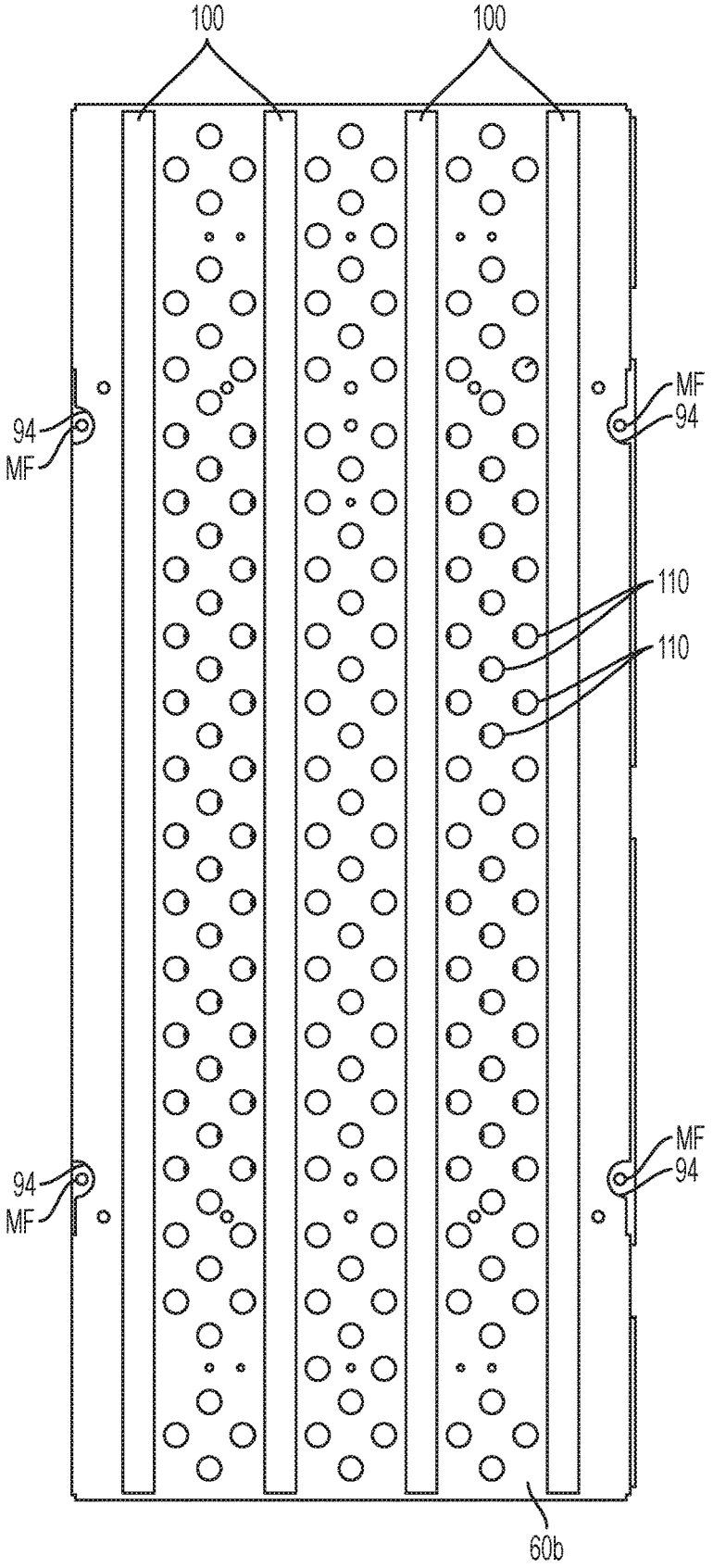
FIG. 10B illustrates the foot section of FIG. 10A with the panels in a retracted configuration.

Referring to FIGS. 10A-10B, a foot section 24 according to some embodiments of the present invention is illustrated. In the illustrated embodiment, panel 60*b* includes a plurality of spaced apart cutouts 94 along opposing edge portions $\mathbf{60}b_1$ and $\mathbf{60}b_2$. The cutouts 94 of panel 60*b* are arranged such that, when panel 60*b* overlies panels 60*a* and 60*c* when the foot section 24 is in a retracted configuration, the cutouts 94 provide room for the mattress support member fasteners MF on panels 60*a* and 60*c*, as illustrated in FIG. 10B. As such, when the foot section 24 is in a retracted configuration, no interference occurs with the fasteners MF that secure the mattress to the panels 60*a*-60*c*.

Figure 9:
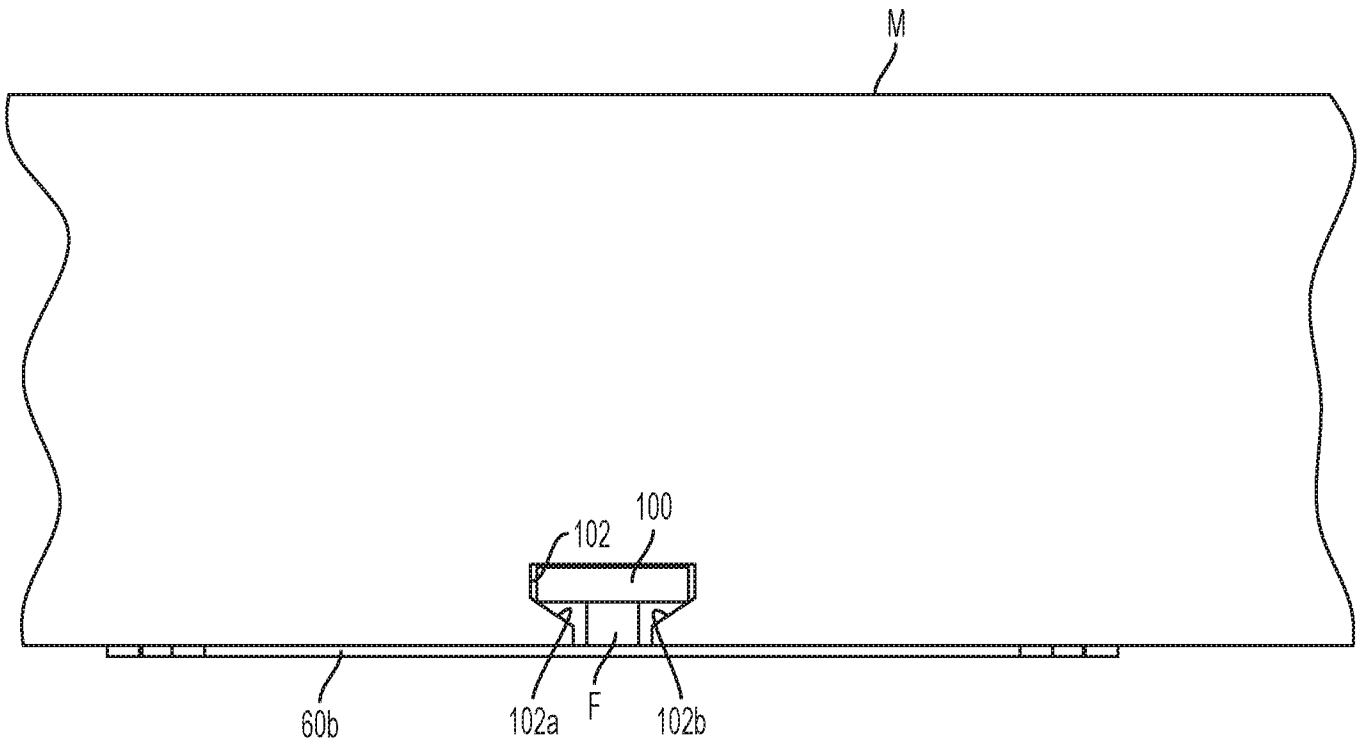
FIG. 9 is a side view of a foot section panel with one of the mattress support members illustrated in FIG. 1, according to some embodiments of the present invention and illustrating a mattress that is secured thereto.

In the illustrated embodiment, mattress support members 100 are secured to panel 60*b*, for example, via fasteners F (FIG. 9) such as bolts or screws, etc. Each mattress support member 100 can be configured to cooperate with an elongated clip 102 secured to or integral with a foot section of a mattress M, as illustrated in FIG. 9. Only a single mattress support member 100 that is attached to panel 60*a* is shown in FIG. 9. Each mattress support member 100 can be secured to the panel 60*b* in elevated, spaced apart relationship via fasteners F such that a respective elongated clip 102 can slidably engage a mattress support member 100. In the illustrated embodiment, each clip 102 has tapered sidewalls 102*a*, 102*b*. However, various configurations are possible. The illustrated configuration allows for easy attachment of a mattress M to the patient support surface 18 of the bed 10 (FIG. 1).

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A hospital bed, comprising:

a base comprising opposite end portions;

a lifting mechanism secured to the base between the end portions; and an upper frame having a patient support surface pivotally secured to the lifting mechanism, wherein the patient support surface comprises a back section, a seat section, and a foot section configured to articulate relative to each other, and wherein the patient support surface is configured to translate from a bed configuration to a full 90-degree side egress chair configuration;

wherein the foot section comprises first, second, and third panels operably connected together and that are configured to move relative to each other in substantially parallel planes between an extended configuration when the patient support surface is in a bed configuration and a retracted configuration when the patient support surface is in the full 90-degree side egress chair configuration, wherein a free end of the foot section is configured to contact a floor surface when the patient support surface is moved into the full 90-degree side egress chair configuration, and wherein contact with the floor surface forces the first panel towards the third panel, under the second panel, and then the second panel over the third panel to move to a fully retracted configuration.

2. The hospital bed of claim 1, wherein the foot section comprises at least four biasing members configured to urge the first and second panels to move away from the third panel back to the fully extended bed configuration.

3. The hospital bed of claim 1, wherein the first panel moves relative to the third panel in a lower first plane, and wherein the second panel moves in an upper second plane.

4. The hospital bed of claim 1, wherein the foot section comprises a frame assembly, the frame assembly comprising:

a pair of spaced-apart two-way sliding guides secured to the second panel;

a pair of first rails, each first rail slidably secured to an outer side of a respective one of the two-way sliding guides and movable relative thereto between retracted and extended positions; and a pair of fixed second rails, each second rail slidably secured to an inner side of a respective one of the two-way sliding guides and movable relative thereto on the fixed second rails between retracted and extended positions.

5. The hospital bed of claim 1, further comprising an actuator configured to move the foot section between a substantially co-planar configuration relative to the seat section and the full 90-degree side egress chair configuration relative to the seat section.

6. The hospital bed of claim 4, further comprising a first biasing member connected to each first rail and outside of a respective two-way sliding guide, wherein the first biasing member is configured to urge the first rail to stay in the extended position relative to the respective two-way sliding guide.

7. The hospital bed of claim 6, wherein the first biasing member comprises an extension spring.

8. The hospital bed of claim 4, further comprising a second biasing member connected to each second rail and inside of a respective two-way sliding guide, wherein the second biasing member is configured to urge the two-way sliding guide to stay in the extended position relative to the respective fixed second rail.

9. The hospital bed of claim 8, wherein the second biasing member comprises an extension spring.

10. The hospital bed of claim 4, wherein each first and second rail comprises a pair of elongate spaced-apart rods, and wherein each rod slidably cooperates with a respective passageway in a receptacle associated with each two-way sliding guide.

11. The hospital bed of claim 4, wherein the first panel is secured to the pair of first rails and a first cross member, and the third panel is secured to a second cross member.

12. The hospital bed of claim 4, wherein the foot section is configured to contact a floor surface when moved to the full 90-degree side egress chair configuration relative to the seat section, and wherein contact with the floor surface causes the pair of first rails and the pair of two-way sliding guides to move to respective retracted positions.

13. The hospital bed of claim 12, wherein the foot section comprises at least two load bearing rollers or wheels configured to contact the floor surface and roll along the floor surface supporting the pressure as the foot section is collapsed while moving to the full 90-degree side egress chair configuration relative to the seat section.

14. A method of translating a hospital bed to a side egress chair configuration, comprising:

articulating back, seat and foot sections of a patient support surface relative to each other from a substantially co-planar configuration to a full 90-degree side egress chair configuration, wherein the foot section includes first, second and third panels operably connected together and that are configured to move relative to each other in substantially parallel planes, one above the other, between an extended home configuration when the patient support surface is in a bed configuration and a retracted configuration when the patient support surface is in the full 90-degree side egress chair configuration;

contacting a floor surface with the foot section; and forcing the first panel to move towards the third panel, under the second panel, and the second panel to move over the first and third panels to the retracted configuration in response to the floor contact.

15. The method of claim 14, wherein the first panel moves toward the third panel in a first plane, and the second panel moves in a second plane above the first and third panels.

16. The method of claim 15, wherein the first and second planes are substantially parallel with moving parts in both planes.

* * * * *